US005134757A

United States Patent [19]

Johnson

[11] Patent Number: 5,134,757

[45] Date of Patent: Aug. 4, 1992

[54] QUICK RELEASE FASTENER

[76] Inventor: Charles R. Johnson, 1017 S. Pointe Alexis Dr., Tarpon Springs, Fla. 34689

[21] Appl. No.: 735,561

[22] Filed: Jul. 25, 1991

[51] Int. Cl.[5] ..... A44B 1/18; F16B 21/00

[52] U.S. Cl. ..... 24/682; 24/90 E; 24/590; 24/685; 411/554

[58] Field of Search ..... 24/682, 683, 662, 685, 24/453, 590, 90 E, 90 C; 135/119; 52/410; 403/348; 411/371, 372, 373, 374, 910, 554, 339

[56] References Cited

U.S. PATENT DOCUMENTS

| | | | |
|---|---|---|---|
| 1,338,783 | 5/1920 | Lobar | 24/90 E |
| 2,118,561 | 5/1938 | Kleeberg | 24/90 E |
| 3,574,901 | 4/1971 | Carlos | 24/682 |
| 4,035,874 | 7/1977 | Liljendahl | 411/339 |
| 4,067,090 | 1/1978 | Schenk | 411/554 |
| 4,308,646 | 1/1982 | Schenk | 411/554 |
| 4,599,768 | 7/1986 | Donle et al. | 411/554 |
| 4,878,792 | 11/1989 | Frano | 411/372 |

*Primary Examiner*—Victor N. Sakran

*Attorney, Agent, or Firm*—Joseph C. Mason, Jr.; Ronald E. Smith

[57] ABSTRACT

A fastener having five parts. A flexible material such as canvas is apertured at a point of connection and a first washer having a boss axially receives the apertures so that the material overlies the washer. The material is held in sandwiched relation between the first washer and a second washer, both of which having gripping surfaces that engage the material. The washers are pressed downwardly by a knob. The knob has a depending central post that releasably engages a lock member that is in turn releasably engaged by a base member that is secured to a support surface. The lock member has a boss part with an annular step that supports the first washer. A pair of flanges extend from a bottom end of the lock member and are engaged by overhanging walls formed in the base member when the knob is turned. The flanges are arcuate so that they resist flattening when the knob is pressed downwardly, and the resistance pushes the washer members upwardly against the downward pushing of the knob, thereby tightly squeezing the material captured between the washer members.

12 Claims, 2 Drawing Sheets

QUICK RELEASE FASTENER

TECHNICAL FIELD

This invention relates, generally, to quick release fasteners. More particularly, it relates to a fastener for detachably securing a flexible material to a hard or flexible surface.

BACKGROUND ART

Canvas is used in the marine industry and in many other industries as well for a multitude of purposes. In many applications, the canvas is used to cover an open compartment or to simply provide shade. In some applications, there is a need to releasably attach it to a hard surface such as the deck of a boat. In other applications, it may be attached to a frame, and in some applications, there is a need to attach it to another flexible material.

The two fasteners most commonly used for releasably retaining canvas or other cloth materials are known as the "common sense" fastener and the "snap" fastener. Both do an adequate job of holding canvas or other cloth to a deck or other surface, but each has at least one disadvantage. More specifically, the common sense fastener has an upwardly extending protuberance that can injure an individual who steps on or bumps against it. The snap fastener is not dangerous if stepped on or bumped against, but it is sometimes very difficult to release, is subject to corrosion, and is sensitive to dirt. More importantly, snap fasteners have poor resistance to a straight outward pull, and they do not capture the cloth very well. Additionally, the snap fastener can be released only by pulling directly on the canvas, cloth, or other material; this is undesirable because if the fastener is stuck and the material is worn, the material may tear before the fastener releases.

Numerous inventors have turned their attention to fasteners and have developed many different types thereof. Some of the new fasteners mar adjacent surfaces, and some of them are just as weak and unreliable as the fasteners they were intended to replace. Some of them avoid trauma-inflicting protrusions, but lack the all-important quick release feature, and so on.

A fastener that has the desirable attributes of the ubiquitous snap fastener and common sense fastener and that is free of their undesirable attributes, however, has heretofore alluded those of ordinary skill in this art and all inventors as well.

DISCLOSURE OF INVENTION

The longstanding but heretofore unfulfilled need for a quick release fastener that overcomes the limitations of the fasteners of the prior art is now fulfilled in the form of a quick release fastener having five parts.

A base member has a flat bottom that abuttingly engages the hard or flexible surface to which the canvas or other item of flexible material is to be secured so that said surface is not marred. The base member may be permanently securable to a hard surface by a screw member or other suitable fastening member; it may be secured to another flexible material by any suitable means as well.

The base member includes a channel formed therein with overhanging walls that capture a lock member that is insertable into said channel.

The lock member has a boss that is internally toothed. It further includes a pair of laterally-extending flanges integral with the boss, at the lower end thereof, that are insertable into the channel formed by the base and that are captured by the overhanging walls of the base when the lock member is rotated ninety degrees. Each flange has a slightly arcuate form to pre-stress it.

A first centrally apertured washer member is axially received by the boss of the lock member. Teeth or other suitable engaging means, such as a knurled or sticky surface, are formed in one of the two toroidal surfaces of the first washer member; these engaging means engage the canvas or other flexible material when the novel fastener is assembled. The first washer includes a boss that circumscribes the boss of the lock member.

A second centrally apertured washer member is axially received by the boss of the first washer member and said second washer overlies the first washer when the novel fastener is assembled. Teeth or other suitable engaging means are formed in one of its toroidal surfaces; these engaging means are disposed in confronting relation to the engaging means formed in the first washer and are complementally formed with respect thereto. The flexible material is positioned in sandwiched relation to the first and second washers so that said material is engaged on both sides by said engaging means. The flexible material is apertured to axially receive the boss of the first washer member.

The fifth part is a hand-turnable knob having a handle part and a post part that depends therefrom, said post being externally toothed to engage the internal teeth of the boss of the lock member when the novel fastener is assembled. The knob has a bottom side that overlies and abuttingly engages the boss of the first washer and the radially innermost part of the second washer so that both washers are driven downwardly when the post of the knob is inserted into the bore of the lock member.

Thus, to secure a piece of canvas or similar material to a hard surface when using the novel fastener, the base member, lock member, and first washer are pre-assembled. An attachment aperture formed in the article of flexible material to be secured is brought into alignment with the boss of the first washer and the material is placed into overlying relation to said first washer. The second washer is then brought into said alignment and placed into overlying relation to the material to be fastened. The external teeth of the depending post of the knob member are then driven into substantially permanent engagement with the internal teeth formed in the bore of the look member boss. This compressively and permanently captures the material between the two washers. The knob is rotated so that the flanges are captured by the overhanging walls, and the fastening procedure is completed. To release the flexible material, the knob is rotated to free the flanges from the overhanging walls of the base member, and the balance of the assembly is separated from the base member; the canvas remains secured between the confronting faces of the washers.

Unlike the common sense and snap fasteners of the prior art, the base of the novel fastener may be placed in a recess so that the top of the base is flush with the deck or other surface. Perhaps even more importantly, the novel fastener can be located anywhere on the material. i.e., it need not be positioned only on the corners thereof. Significantly, releasing the novel fastener does not require pulling on the material itself.

Thus, the primary object of the present invention is to advance the art of fasteners by providing a quick release fastener that is safe and effective.

Another important object is to provide a fastener of elegant construction so that it is economical to manufacture and thus easily affordable.

Still another object is to provide a fastener having a gripping ability that surpasses the gripping ability of conventional fasteners.

These and other important objects, features, and advantages of the invention will become apparent as this description proceeds.

The invention accordingly comprises the features of construction, combination of elements, and arrangement of parts that will be exemplified in the construction hereinafter set forth and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings in which.

BEST MODES FOR CARRYING OUT THE INVENTION

Figure 1:
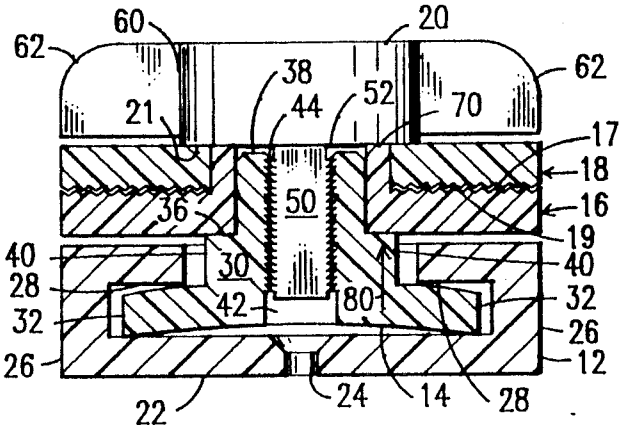
FIG. 1 is a sectional view taken along a diameter of the novel fastener.
Figure 5:
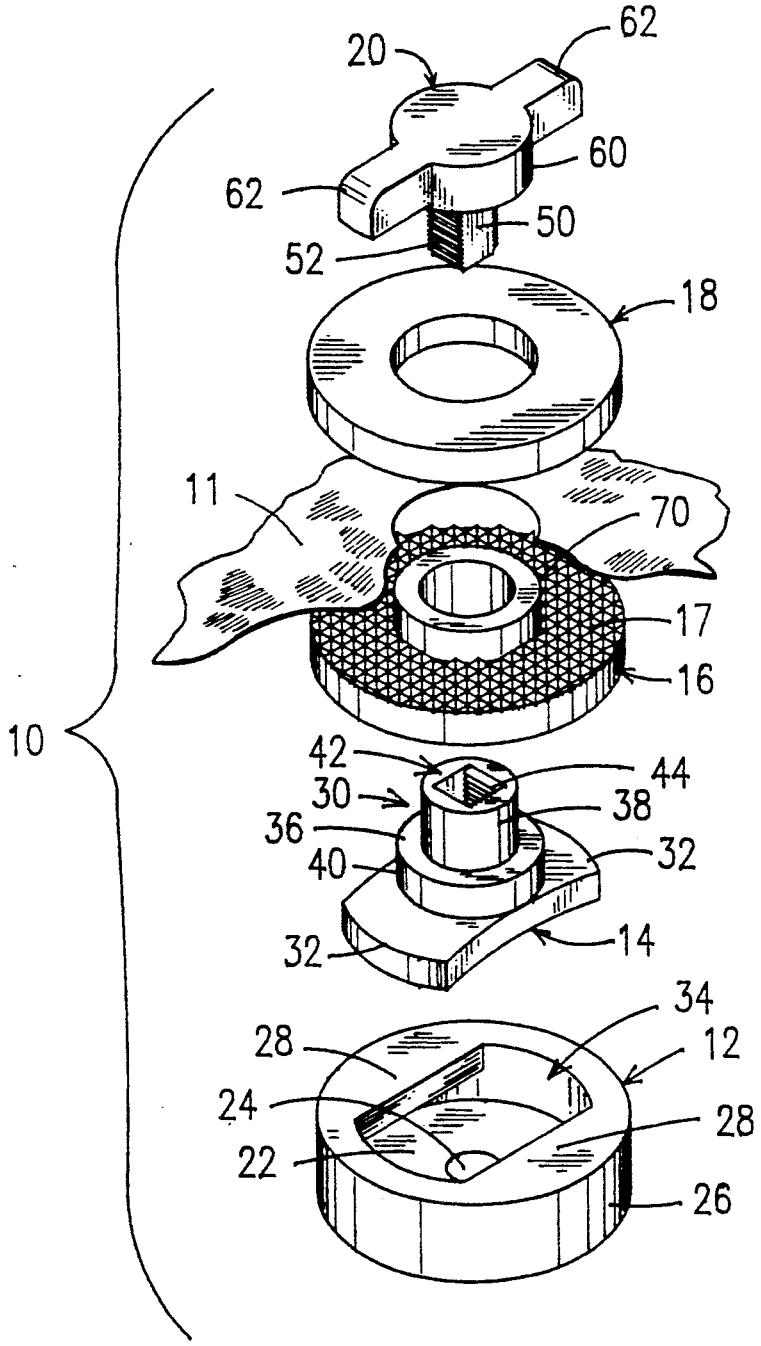
FIG. 5 is an exploded perspective view of the fastener.

Referring now to FIGS. 1 and 5, it will there be seen that an illustrative embodiment of the invention is denoted as a whole by the reference numeral 10.

Fastener 10 includes base member 12, lock member 14, first washer 16, second washer 18, and knob 20.

It should be understood from the outset that the item of flexible material (11 in FIG. 5) to be fastened is held in sandwiched relation between the confronting surfaces of the first and second washers when the invention is in use.

Figure 2:
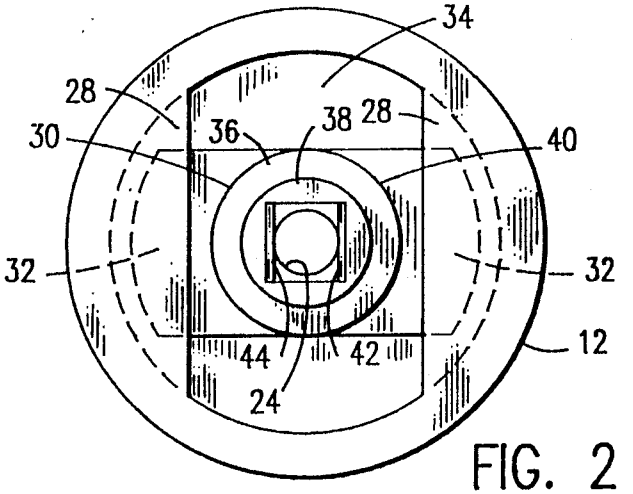
FIG. 2 is a top plan view of the novel fastener.
Figure 3:
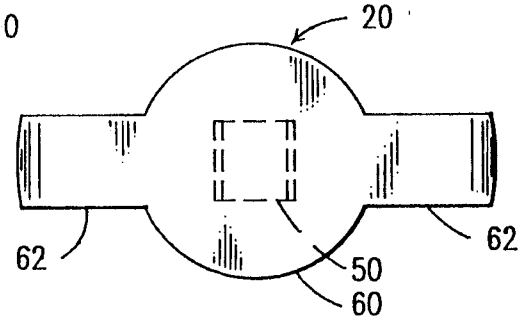
FIG. 3 is a top plan view of the knob part thereof.
Figure 4:
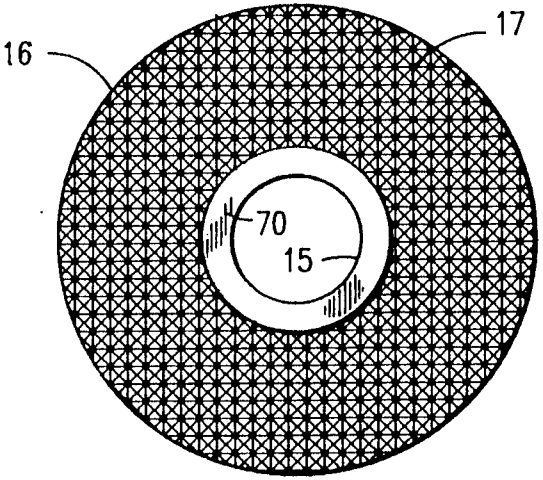
FIG. 4 is a top plan view of the first washer member.

Base 12 is preferably round when seen in plan view as depicted in FIG. 2, but may be provided in any preselected geometrical configuration. It has a flat bottom wall 22 that is centrally apertured as at 24, upstanding cylindrical side walls 26 projecting upwardly from the peripheral border of said bottom wall, and radially inwardly extending overhanging walls 28 that are integral with the uppermost free ends of said side walls. A screw, not shown, or other suitable fastening device, extends through aperture 24 and secures base 12 to a support surface such as the deck of a boat.

Overhanging walls 28 perform a capturing function; they capture lock member 14 and retain it within base 12. More particularly, lock 14 includes a central, upstanding boss 30 having a bore formed therein and a pair of laterally extending flanges, collectively denoted 32, that extend in opposite directions from a bottom end of boss 30 and which are captured by overhanging walls 28 when the novel fastener 10 is assembled. Note that flanges 32 are arcuate in form. As should be clear from FIGS. 2 and 5, flanges 32 are first aligned with channel 34, said channel being defined by base 12, inserted thereinto, and rotated ninety degrees into the position depicted in FIGS. 1 and 2. The width of flanges 32 is a little less than the width of channel 34, but the length of said flanges is greater than the width of the channel so that the opposite ends of the flanges are captured beneath the overhanging walls 28 as shown in FIG. 2 after lock 14 has been rotated.

Boss 30 of lock 14 has an annular step 36 formed therein, about mid-height thereof; step 36 is formed where top part 38 of boss 30 meets bottom part 40 thereof (FIG. 5), said top part having a first predetermined diameter less than the second predetermined diameter of bottom part 40.

A square bore 42 is formed in boss 30, i.e., said square bore is formed in both top part 38 and bottom part 40 thereof as is perhaps best understood in connection with FIG. 1. Internal teeth 44 are formed in opposed side walls of bore 42.

Knob 20 has a square-in-section depending central post 50 that is externally toothed as at 52 to engage the internal teeth 44 of bore 42. Thus, knob 20 and look 14 are interlocked by the simple expedient of inserting post 50 into bore 42.

Knob 20 further includes a disc-shaped head 60 and a pair of diametrically extending wings 62 to facilitate rotation of head 60. The interlocking of square post 50 and square bore 42 assure that lock 14 having flanges 32 will rotate conjointly with head 60 when it is turned. Thus, it should be understood that the above-mentioned rotation of flange 32 into captured relation with overhanging walls 28 of base 12 is accomplished by rotation of knob 20 after post 50 has engaged bore 42.

The novel construction is completed by centrally apertured washers 16, 18. Note that teeth 17 or other suitable gripping means are formed on a preselected toroidal surface of washer 16 and that teeth 19 or other suitable gripping means are formed on a preselected confronting toroidal surface of washer 18. Teeth 17 and 19 engage opposite sides of the canvas or other flexible material sandwiched therebetween as should be clear from an inspection of FIG. 1.

Washer 16 has a boss 70 that circumscribes and slidably abuts upper part 38 of boss 30 of lock 14; when knob 20 is rotated to rotate look 14, the position of washer 16 is unaffected due to said sliding engagement. Washer 18 has no such boss and is toroidal in configuration as depicted; its central aperture has a diameter sufficient to accommodate boss 70 of washer 16 as is clearly shown in FIG. 1. Thus, boss 70 serves to center washer 18 atop washer 16.

The canvas or other material 11 is apertured at each of its points of attachment as depicted in FIG. 5 so that boss 70 of washer 16 fits therethrough. The points of attachment need not be restricted to the corners of the material. Thus, the material is placed into overlying relation to teeth 17 of washer 16 and washer 18 is then placed into overlying relation to said material. Post 50 is then inserted into bore 42 and the underside 21 of knob 20 bears against boss 70 of first washer 16 and the radially innermost part of second washer 18 as clearly shown in FIG. 1 and the flexible material is thereby secured against movement. When post 50 is pressed down, arcuate flanges 32 are forced into a flattened condition and the resiliency thereof provides a bias which drives washer 16 toward washer 18, i.e., lower part 40 of lock 14 is biased in the direction of arrow 80 (FIG. 1), thereby urging washer 16 in the same direction while said underside 21 of knob 20 urges second washer 18 in the opposite direction so that said first and second washer members are pressed toward one another, thereby providing a non-slip grip on the flexible material sandwiched therebetween.

To release the flexible material, knob 20 is rotated with the aid of wings 62 until flanges 32 of look 14 align with channel 34 defined by overhanging walls 28; the knob and hence the lock are then lifted as a unit. Washer 16 and hence washer 18 are lifted from step 36; washer 18 cannot be separated from washer 16 until post 50 is pulled from bore 42; such separation of post 50 from bore 42 would require the breaking of teeth 44 and the device is not intended to be broken. At no time is the material pulled on; this is in sharp and distinct contrast to the snap fasteners of the prior art.

Fastener 10 is preferably formed of elastomeric materials. Its construction is such that it may be injection molded and thus producible in large quantities at low unit cost.

This invention is clearly new and useful. Moreover, it was not obvious to those of ordinary skill in this art at the time it was made, in view of the prior art considered as a whole in accordance with the requirements of law.

It will thus be seen that the objects set forth above, and those made apparent from the foregoing description, are efficiently attained and since certain changes can be made in the above description without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A quick release fastener, comprising:

a base member having a flat bottom wall adapted to be secured to a support surface;

said base member including upstanding side walls mounted about the periphery of said flat bottom wall and further including radially inwardly extending overhanging walls;

a lock member adapted to releasably engaged said base member;

said lock member including an upstanding central boss and a pair of flange members that extend laterally in opposite directions from a bottom end of said boss;

said boss having a central bore formed therein and having internal teeth members formed in said central bore;

a first centrally apertured washer member adapted to circumscribe and to at least partially overlie said lock member;

a second centrally apertured washer member adapted to overlie said first washer member; and a knob adapted to releasably engage said lock member and to overlie at least a part of said first and second washer members;

whereby said lock member is engaged to said base member, and item of sheet material to be secured is placed into sandwiched relation between said first and second washer members and said knob is engaged to said lock member to thereby drive said first and second washer members toward one another and hence to tightly secure said sheet material between said first and second washer members.

2. The fastener member of claim 1, wherein said knob has a head and a post that depends therefrom, said post having external teeth formed therein to releasably engage the internal teeth members formed in said central bore of said boss.

3. The fastener of claim 2, wherein said central bore of said boss has a square configuration and wherein said depending post is also of square configuration so that rotation of said post effects simultaneous and corresponding rotation of said lock member.

4. The fastener of claim 3, further comprising a pair of wing members that extend laterally from the head of said knob to facilitate turning of said knob.

5. The fastener of claim 4, further comprising an annular step formed in said boss, said annular step dividing said boss into an upper part having a first diameter and a lower part having a second diameter, said first washer member being supported by said annular step when the fastener is assembled.

6. The fastener of claim 5, wherein said first washer member further includes a boss that circumscribes the upper part of said lock member boss and that is slidably mounted with respect thereto so that knob-imparted rotation of said lock member is not transmitted to said first washer member.

7. The fastener of claim 6, wherein the central aperture of said second washer member has a diameter sufficient to accommodate the boss of said first washer member.

8. The fastener of claim 7, wherein said knob overlies and abuttingly engages said boss of said first washer member and a radially innermost part of said second washer member when said fastener is assembled.

9. The fastener of claim 8, wherein a preselected surface of said first washer member has engaging means formed therein for securely engaging the sheet material and wherein a preselected surface of said second washer member has complementary engaging means formed therein so that the material is securely engaged between said first and second washer members.

10. A fastener for releasably securing a flexible material to a preselected surface, comprising:

a base member having a flat bottom wall, side walls mounted about the periphery thereof and projecting upwardly therefrom, and radially inwardly directed overhanging walls formed at the uppermost free ends of said side walls;

a lock member having a boss part and a pair of flange members that extend laterally in opposite directions from a lower end of said boss part, said flange members being captured beneath said overhanging walls when the fastener is assembled;

a step formed in said boss part, about mid-height thereof, said step dividing said boss part into an upper part having a first diameter and a second part having a second diameter, said first diameter being less than said second diameter;

a first washer having a central aperture of sufficient diameter to axially receive said upper part of said boss part;

said first washer having a boss;

a second washer having a central aperture of sufficient diameter to axially receive said boss of said first washer;

a hand-rotatable knob member having a head and a post that depends from the head;

said boss of said lock member having a central bore formed therein and a plurality of internal teeth members being formed in said central bore;

said post having external teeth formed therein along its extent so that when said post is inserted into said bore, said internal and external teeth compressively engage one another;

said first and second washers having gripping means formed on confronting surfaces thereof so that a flexible material sandwiches therebetween is gripped by said gripping means.

11. The fastener of claim 10, further comprising a pair of wing members that extend in opposite lateral directions from said knob head to facilitate hand turning of said knob.

12. The fastener of claim 10, wherein said post and said central bore are square in section so that rotation of said post imparts simultaneous and corresponding rotation to said lock member.

* * * * *